United States Patent [19]

Alquist et al.

[11] 4,022,589

[45] May 10, 1977

[54] FUEL ADDITIVE PACKAGE CONTAINING POLYBUTENE AMINE AND LUBRICATING OIL

[75] Inventors: Henry E. Alquist, Bartlesville, Okla.; George D. Ebersole, Lenox, Iowa

[73] Assignee: Phillips Petroleum Company, Bartlesville, Okla.

[22] Filed: Oct. 17, 1974

[21] Appl. No.: 515,606

[52] U.S. Cl. ..... 44/58; 44/71; 252/50

[51] Int. Cl.[2] ..... C10L 1/22

[58] Field of Search ..... 44/58, 72; 252/50

[56] References Cited

UNITED STATES PATENTS

| | | | |
|---|---|---|---|
| 3,424,565 | 1/1969 | Ptacek et al. | 44/72 |
| 3,438,757 | 4/1969 | Honnen et al. | 44/72 |
| 3,565,804 | 2/1971 | Honnen et al. | 44/72 |
| 3,573,010 | 8/1968 | Mehmedbasich | 44/72 |
| 3,574,576 | 4/1971 | Honnen et al. | 44/72 |
| 3,752,657 | 8/1973 | Richardson | 44/72 |
| 3,753,905 | 8/1973 | Souillard et al. | 44/58 |

*Primary Examiner*—Daniel E. Wyman
*Assistant Examiner*—Y. Harris-Smith

[57] ABSTRACT

A fuel additive system comprising 10 to 50 parts by weight of a polybutene amine detergent having an average molecular weight in the range of 600–3,000 and having a nitrogen content in the range of 0.5 to 3 weight percent and 100 to 500 parts by weight of a solvent-refined paraffinic lubricating oil having a viscosity in the range of 250 to 500 SUS at 100° F.

6 Claims, No Drawings

FUEL ADDITIVE PACKAGE CONTAINING POLYBUTENE AMINE AND LUBRICATING OIL

This invention relates to gasoline additives.

The catalytic converter is now generally accepted as one of the best available means for reducing the level of exhaust emissions from internal combustion engines. While advances in catalytic converters have been made in recent years, the catalytic converters are not without certain drawbacks. The converters must be hot in order to be active in converting unburned hydrocarbons and carbon monoxide. During the warm-up period of the engine, the catalytic converters are relatively ineffective to convert such hydrocarbons and carbon monoxide. Additionally, the fuel:air ratio is relatively critical to maintain efficient catalytic conversion thus to minimize exhaust emissions. In starting a cold engine, the fuel:air ratio is considerably higher than normal due to operation of the choke. Exhaust emissions are correspondingly higher during this period.

In an effort to reduce the high level of unburned hydrocarbons and carbon monixide during the start and warm-up period, at least one automobile manufacturer has suggested a system to insure more complete vaporization of incoming fuel droplets in the intake manifold thus permitting the choke to be turned off as soon as possible after start-up. This system is designated an Early Fuel Evaporation (EFE) system.

One prototype EFE system consists of a thin section stainless plate located within the intake manifold just beneath the carburetor opening. This plate acts to transfer heat from the exhaust crossover to liquid fuel striking the plate, thus reducing the time the choke is needed to keep the engine running. During engine warm-up, the plate achieves a surface temperature of 300°–400° F. Once the engine is sufficiently warmed, exhaust heat is diverted from the EFE plate.

There is concern that the EFE plate presents a potential area for formation of fuel related deposits. Such deposits would insulate the plate against proper heat transfer to the incoming fuel, thus decreasing its effectiveness. The problem of deposit formation is prevented, in some degree, by detergents already included in motor fuels. However, there is an ongoing search for improved detergents for use in internal combustion engine fuels.

It is an object of this invention to provide an improved detergent additive system for an internal combustion engine fuel.

It is another object of this invention to provide an improved fuel for internal combustion engines.

Other objects, aspects and advantages of the invention will be readily apparent to those skilled in the art upon a reading of the specification and appended claims.

In accordance with the present invention, there is provided an improved detergent additive system for internal combustion engine fuels which comprises (a) 10 to 50 parts by weight of a polybutene amine detergent having an average molecular weight in the range of 600–3,000 and having a nitrogen content in the range of 0.5 to 3 weight percent and (b) 100 to 500 parts by weight of a solvent-refined paraffinic lubricating oil having a viscosity in the range of 250 to 500 SUS at 100° F. Optionally, the additive system can contain (c) from 0.1 to 5 parts by weight of a demulsifying agent and (d) a suitable solvent in an amount sufficient to facilitate injection of the additive system into a fuel stream.

The additive system of this invention is used in an internal combustion engine fuel in an effective amount, i.e., an amount sufficient to substantially prevent fuel deposits. Generally, this amount will be in the range of about 110 to about 550 pounds of additive system, that is, components (a) and (b), per 1,000 barrels of fuel (ptb), although lesser or greater amounts of additive can be used, if desired.

The polybutene amine detergents which are suitable for use in the present invention are commercially available materials which are known to have detergent or dispersant properties. These detergents can be prepared by any procedure known in the art, such as by the procedure disclosed in U.S. Pat. No. 3,438,757. Briefly, the process involves halogenating a relatively low molecular weight polybutene such as polyisobutylene, followed by reaction with a suitable straight chain amine such as ethylenediamine. The polybutene amine detergent will generally have an average molecular weight in the range of 600–3,000 and will have been reacted with sufficient amine to contain from 0.5 to 3 weight percent nitrogen.

The lubricating oil which is suitable for use in the present invention is a solvent-refined, substantially paraffinic lubricating oil, such as that obtained as the lubricating oil fraction of a Mid-Continent crude oil. Such an oil will have a paraffin content of at least about 55 volume percent and a naphthenes content of less than about 35 volume percent. The viscosity of the oil will be in the range of 250–500 SUS at 100° F. Particularly suitable is a Mid-Continent solvent-refined paraffinic neutral oil having a viscosity of about 300–325 SUS at 100° F, which is suitable for formulation into lubricating oils of SAE-20 weight. Such an oil is commonly referred to as a 20-stock oil.

It is generally considered beneficial to include a minor amount of a material which has demulsifier properties in the additive package of the present invention. Such a component, though preferred, is not essential to the deposit-inhibiting effect of the additive system of the present invention. Any material which is compatible with motor fuels and which exhibits demulsification properties when utilized at relatively low levels such as 0.1–5 pounds per 1,000 barrels of fuel can be used. Due to the low dosage of such material, it has no tendency to interfere with the deposit-inhibiting effects of the additive system or the combustion characteristics of the motor fuel.

Illustrative of demulsifying agents suitable for use in the present invention, but not limited thereto, are the oxyalkylated alkylphenolformaldehyde polymers as disclosed in U.S. Pat. Nos. 2,499,367, 3,424,565 and 3,752,657.

The additive system of the present invention can be prepared as a concentrate by dissolving the active ingredients in a volatile solvent which boils in the range of about 150° to 400° F. Aliphatic alcohols and aromatic or saturated aliphatic hydrocarbons are suitable. Some examples are isopropanol, benzene, xylene and the like. Sufficient solvent is employed to provide a concentrate containing 10–70 weight percent of the detergent and lubricating oil.

In addition to the components described above, the motor fuel or the preformed additive concentrate can contain other conventional additives such as antioxidants, rust inhibitors, colorants, antifreeze agents and the like.

The fuels employed are compositions comprising straight chain paraffins, branched chain paraffins, olefins, aromatic hydrocarbons and naphthenic hydrocarbons. These fuels will generally have initial boiling points of about 70° F and final boiling points of about 450° F (ASTM D-86). The specifications for conventional gasolines are set forth in ASTM D-439-70. The fuel components can be derived by any of the conventional refining and blending processes, such as straight run distillation, thermal cracking, hydrocracking, catalytic cracking and various reforming processes. Synthetic fuels are also included.

The motor fuel particularly suitable for use with the additive system of this invention is an essentially unleaded fuel which boils in the conventional motor fuel range of from about 70° F to about 450° F.

The additive system of the present invention can be added to a suitable motor fuel as a mixture or separately in any order using conventional fuel additive injection methods. It is presently preferred to inject the additive system as a pre-mixed concentrate package. Thus, a mixture of the polybutene amine component, the lubricating oil component and a demulsifier can be dissolved in a suitable liquid carrier such as xylene and the concentrate package added to the motor fuel in the desired amount.

The following examples illustrate the invention:

All the comparsion tests described below were obtained with a 1973, 350 CID Chevrolet, 4-barrel engine equipped with a special manifold to accommodate a prototype EFE plate. The EFE plate was a thin section stainless steel plate located just beneath the carburetor for the purpose of permitting quick transfer of heat from the exhaust crossover to the liquid fuel droplets striking the plate in the intake manifold. Thus, one surface of the plate was in contact with the liquid fuel droplets coming from the carburetor while the other side of the plate was in contact with hot exhaust gases coming from the exhaust manifold. A total of seven thermocouples were attached in systematic fashion to the surface of the EFE plate such that the temperature of the surface of the plate, which was in contact with the fuel, could be measured to get an average plate temperature.

The test conditions were as follows. The engine was operated in 15-minute cycles which included a 10-minute engine firing period (fuel on) and a 5-minute engine motoring period (fuel off). In the engine firing period the engine speed was 1200 rpm, the intake manifold vacuum was 7.3 inches of mercury, the load was 36 bhp, the coolant out temperature was 175° F, and the crankcase oil temperature was 215° F. The 15-minute cycles were repeated until a test duration of 45 hours was reached.

At the beginning of the test, the plate surface temperature was adjusted to a temperature in the range of 300°–400° F through adjustment of the heat-riser valve. This valve was then locked into place and did not move throughout the test.

At the completion of the test, the change in the surface temperature of the EFE plate from the temperature of the plate at the start of the test was noted. Because the exhaust temperature tended to drift from its original temperature, the differential plate temperatures were corrected by the amount of drift in the exhaust temperature. Thus, all average differential plate temperatures (intake side) were corrected by algebraically subtracting the differential exhaust temperature. The values recorded and shown in the table following are the net differential temperatures, ΔT.

The change in plate temperature resulting from a test is taken to be a measure of the relative rate of heat transfer through the plate. Higher ΔT represent poor heat transfer, lower ΔT represent better heat transfer. Since the buildup of deposits during a test tends to insulate the plate thereby resulting in lower surface temperatures, deposits tend to decrease the rate of heat transfer, and higher temperatures result. Thus, any fuel treatment such as the use of additives that tends to diminish the rate of deposit build up would be reflected by lower net ΔT.

At the completion of the test, the plate was removed from the fuel system of the engine and given a merit rating based on visual observation. In this technique, the percentages of 5 possible deposit levels were determined and then multiplied by appropriate weighting factors. The sum of the resulting products was then taken as the overall merit rating. The factors for the deposit levels of no deposit, brown stain, black stain, medium deposits, and heavy deposits were 10, 7.5, 5.0 2.5, and 0, respectively. Thus, a final merit rating of 10 would indicate a clean plate free of all deposits. Ratings less than 10 would indicate the presence of deposits in corresponding amounts.

An unleaded fuel was used in all the tests. The physical properties of the test fuel are shown in Table I below.

Table I

| Physical Properties of Unleaded Test Fuel (40% Alkylate, 60% Cat-cracked) | |
|---|---|
| Property | Value |
| Gravity, API at 60/60 | 66.2 |
| Distillation, % overhead | |
| IBP | 96° F |
| 10% | 136° F |
| 50% | 213° F |
| 90% | 320° F |
| EP | 399° F |
| RVP | 7.8 |
| Motor Octane No. | 85.8 |
| Research Octane No. | 94.3 |
| TEL, g/gal | < 0.03 |
| Sulfur, wt. % | 0.03 |
| ASTM Gum, mg/100 ml | |
| Unwashed | 2.0 |
| Heptane-washed | 1.9 |
| Hydrocarbon Type, vol. % | |
| Paraffins | 68.0 |
| Olefins | 16.6 |
| Naphthenes | 5.1 |
| Aromatics | 10.3 |

Three oils were utilized in the tests. One was a conventionally refined, relatively heavy naphthenic oil designated A, the second was a relatively light paraffinic lubricating oil, designated B. The third was a still lighter paraffinic lube oil fraction, designated C. A description of these oils is shown in Table II.

Table II

| Properties of Lubricating Oil Fractions | | | |
|---|---|---|---|
| | A | B | C |
| Density at 20° C | 0.9158 | 0.8768 | 0.8579 |
| Refractive Index | 1.5035 | 1.4845 | 1.4742 |
| Mol. Wt. (osmometer) | 462 | 451 | 341 |
| Mol. Wt. (GPC) | — | 424 | 327 |
| Viscosity at Temp. ° F | | | |
| 100 | 1716 | 310.1 | 96.71 |
| 210 | 86.08 | 53.41 | 39.2 |
| 350 | 37.26 | 34.50 | — |
| 400 | 34.16 | 32.52 | — |

Table II-continued

| Properties of Lubricating Oil Fractions | A | B | C |
|---|---|---|---|
| Viscosity Index | 20 | 101 | — |
| Hydrocarbon Breakdown | | | |
| Aromatics, % | 11 | 6 | 4.5 |
| Naphthenes, % | 37 | 29 | 31.0 |
| Paraffins, % | 52 | 65 | 64.5 |

The polybutene amine detergent utilized in the tests was a commercial product (Chevron OGA 472) having a molecular weight of 1774 (by osmometry) indicating an average of about 32 isobutylene units per molecule. Sufficient amine was present to provide a nitrogen content of 1.44 weight percent.

Also included in the tests was a minor amount of a conventional demulsifying agent (available commercially as Chevron OGA-473). Although this material was present in most of the tests, it was present in very small amounts and it was believed to have no effect on the deposit-inhibition aspects of the additive system.

The unleaded fuel, lubricating oils, polybutene amine detergent and demulsifying agent were blended together in amounts sufficient to provide the concentration shown in Table III below, expressed in pounds per thousand barrels of fuel (ptb). A number of 45-hour test runs were carried out using the various fuel blends. The results of runs using the unleaded fuel alone, the fuel plus additive combinations outside the scope of this invention and the fuel plus the additive combination of this invention are shown in Table III.

Table III

| Run No. | 1[a] | 2[b] | 3 | 4[c] | 5 | 6 | 7 | 8[d] | 9 |
|---|---|---|---|---|---|---|---|---|---|
| | EFE Test Results | | | | | | | | |
| Oil Descrip. | — | — | A | A | A | A | A | B | B |
| Oil Conc., ptb | 0 | 0 | 415 | 415 | 207.5 | 415 | 103.8 | 415 | 415 |
| Detergent, ptb | 0 | 173 | 0 | 173 | 86.5 | 43.25 | 43.25 | 0 | 173 |
| Demulsifier, ptb | 0 | 2.6 | 0 | 2.6 | 1.3 | 0.65 | 0.65 | 0 | 2.6 |
| Deposit Rating (10 = clean) | 5.5 | 4.5 | 6.2 | 7.4 | 4.8 | 6.7 | 3.8 | 5.9 | 8.1 |
| Temp. ° F | | | | | | | | | |
| Avg. at start | 354 | 397 | 371 | 363 | 381 | 364 | 365 | 383 | 335 |
| Net $\alpha T$ | 28 | 12 | −3[f] | 8 | 11 | 12 | 19 | 14 | 3 |
| Run No. | 10[e] | 11 | 12 | 13 | 14[d] | 15[d] | 16 | 17 | 18 |
| Oil Descrip. | B | B/C | B | B | B | B | B | B | B |
| Oil Conc., ptb | 415 | 207.5/ 207.5 | 350 | 300 | 207.5 | 300 | 415 | 350 | 300 |
| Detergent, ptb | 43.25 | 43.25 | 43.25 | 43.25 | 43.25 | 31.27 | 21.5 | 21.5 | 21.5 |
| Demulsifier, ptb | 0.65 | 0.65 | 0.65 | 0.65 | 0.65 | 0.47 | 0.32 | 0.32 | 0.32 |
| Deposit Rating (10 = clean) | 7.6 | 6.5 | 7.8 | 7.5 | 6.0 | 8.0 | 6.6 | 7.4 | 7.5 |
| Temp. ° F | | | | | | | | | |
| Avg. at start | 352 | 375 | 334 | 333 | 373 | 318 | 335 | 338 | 335 |
| Net $\alpha T$ | 3 | 10 | 5 | 1 | 4 | 8 | 9 | 7 | 3 |

[a]Average of 6 runs.
[b]23-hour test (instead of 45 hours).
[c]Average of 5 runs.
[d]Average of 2 runs.
[e]Average of 7 runs.
[f]Apparently anomalous value.

Run 1 of Table III illustrates the problem to which the present invention is a solution. When an untreated fuel is subjected to contact with a heated EFE plate over a period of time, substantial deposits are formed on the plate which are indicated by the poor (low) deposit merit rating and the poor (high) net ΔT. Run 2 shows that the problem is slightly alleviated by incorporating a suitable dispersant into the fuel. Run 3 also indicates that incorporating an oil component to the fuel also slightly alleviates the problem. Run 4 shows that a combination of a dispersant and a relatively heavy oil component (comparison oil A) is more effective. Runs 4 through 7 show the effects of various proportions of the polybutene amine and the comparison oil A which is outside the scope of the present invention.

Run 8 shows the mildly beneficial effect of a fuel additive which consists only of the B oil component of the additive combination of the present invention. Invention run 9, on the other hand, shows the excellent results obtained when both the polybutene amine detergent and the oil component of the present invention are used in combination. Run 9 displays a very good deposit merit rating and also shows a desirably low net ΔT which indicates a relatively low level of deposits on the plate. Invention run 10 shows that this same excellent result is maintained even though the dispersant level is reduced by 3/4.

In run 11, half of the amount of the oil B was replaced by another less viscous but closely related paraffinic oil, C. Comparing this run 11 with the invention run 10 again shows that the nature of the oil component is critical. The poorer results of run 11 show that oil C is not interchangeable with oil B.

Invention runs 12–18 indicate that improved results can still be obtained even when the concentration of the oil component and the detergent are reduced still more from the level of that in run 10. Additionally, invention runs 12 through 18 provide still further comparisons with similar additive combinations in runs 4 through 7 in which the oil A component, outside the scope of the present invention, was used. Specifically, invention runs 12 through 15 can be compared with, and show advantage over, comparison runs 4 through 7 in that equivalent or better results are obtained with lower concentrations of the invention additive combination. Invention runs 16 through 18 show similar advantage over comparison runs 5 through 7.

It has been found that higher initial plate temperatures tend to slightly increase the severity of the test. However, the effectiveness of the invention additive system is essentially constant between 300° and about 375° F.

Thus, the data in the table above show that the additive system of the present invention is effective in minimizing deposits on an early fuel evaporation plate in the fuel system of an engine. Further, the data also show that the oil component of the additive combination is critical and that superior results are obtained if the oil component is within this scope described in the present invention. Results with oils both heavier and lighter than the invention oil give poorer results.

Reasonable variations and modifications, which will be apparent to those skilled in the art, can be made in this invention without departing from the spirit and scope thereof.

What is claimed is:

1. A fuel composition comprising a liquid hydrocarbon fuel having therein from 10 to 50 pounds per 1,000 barrels of said fuel of a polybutene amine having an average molecular weight in the range of 600 to 3,000 and from 100 to 500 pounds per 1,000 barrels of said fuel of a paraffinic hydrocarbon oil having a viscosity at 100° F between 250 and 500 SUS.

2. The composition of claim 1 additionally having therein from 0.1 to 5 pounds per 1,000 barrels of said fuel of an oxyalkylated alkylphenol-formaldehyde polymer as demulsifier.

3. The composition of claim 1 wherein said fuel in an unleaded motor fuel having a boiling point in the range of about 70° F to about 450° F.

4. The composition of claim 1 wherein said oil is a solvent-refined paraffinic neutral oil having a viscosity at 100° F in the range of about 300–325 SUS.

5. A detergent additive concentrate for let down in liquid hydrocarbon fuels consisting essentially of a volatile solvent having a boiling point in the range of about 150° to 400° F selected from the group consisting of aliphatic alcohols, saturated aliphatic hydrocarbons and aromatic hydrocarbons, said solvent having dissolved therein from 10 to 70 weight percent of a mixture of 10 to 50 parts by weight of a polybutene amine having an average molecular weight in the range of 600 to 3,000, from 100 to 500 parts by weight of a paraffinic hydrocarbon oil having a viscosity at 100° F between 250 and 500 SUS, and, optionally, from 0.1 to 5 parts by weight of a demulsifying agent.

6. The composition of claim 5 wherein said agent is an oxyalkylated alkylphenol-formaldehyde polymer.

* * * * *